US009831583B2

(12) United States Patent
Matsuoka

(10) Patent No.: US 9,831,583 B2
(45) Date of Patent: Nov. 28, 2017

(54) CONNECTOR

(71) Applicant: 3M INNOVATIVE PROPERTIES COMPANY, St. Paul, MN (US)

(72) Inventor: Hiroyuki Matsuoka, Kanagawa (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/787,313

(22) PCT Filed: Jan. 13, 2014

(86) PCT No.: PCT/US2014/011202
§ 371 (c)(1),
(2) Date: Oct. 27, 2015

(87) PCT Pub. No.: WO2014/185992
PCT Pub. Date: Nov. 20, 2014

(65) Prior Publication Data

US 2016/0079695 A1 Mar. 17, 2016

(30) Foreign Application Priority Data

May 17, 2013 (JP) ..... 2013-104996

(51) Int. Cl.
*H01R 12/00* (2006.01)
*H01R 12/79* (2011.01)

(52) U.S. Cl.
CPC ..... *H01R 12/79* (2013.01)

(58) Field of Classification Search
CPC ..... H01R 12/79; H01R 12/89; H01R 12/88; H01R 13/62; H01R 13/6275
USPC ..... 439/67
See application file for complete search history.

(56) References Cited

U.S. PATENT DOCUMENTS

| | | | | |
|---|---|---|---|---|
| 7,101,220 | B2 * | 9/2006 | Satou | H01R 12/89 439/492 |
| 7,553,183 | B2 | 6/2009 | Taketomi et al. | |
| 8,939,790 | B2 * | 1/2015 | Jung | H01R 13/62 439/483 |
| 9,070,993 | B2 * | 6/2015 | Honda | H01R 12/88 |
| 9,166,332 | B2 * | 10/2015 | Matoba | H01R 13/6275 |
| 2005/0170685 | A1 | 8/2005 | Satou | |

(Continued)

FOREIGN PATENT DOCUMENTS

| | | |
|---|---|---|
| EP | 0 851 539 | 7/1998 |
| JP | 2001-250648 | 9/2001 |

(Continued)

OTHER PUBLICATIONS

PCT International Search Report from PCT/US2014/011202 dated Feb. 28, 2014, 3 pages.

*Primary Examiner* — Jean F Duverne
(74) *Attorney, Agent, or Firm* — Robert S. Moshrefzadeh

(57) ABSTRACT

Connector is provided that includes a plurality of first and second terminals that are arranged in parallel and include contact portions, mounting portions, and intermediate portions that connect the contact portions and the mounting portions. The contact portions are disposed along first and second columns that are mutually offset. The intermediate portion of the first terminal has an overlapping region formed along the first column so as to overlap with at least a portion of an adjacent second terminal.

2 Claims, 11 Drawing Sheets

(56) References Cited

U.S. PATENT DOCUMENTS

| | | | | |
|---|---|---|---|---|
| 2006/0199410 | A1* | 9/2006 | Chen | H01R 12/592 439/260 |
| 2007/0010127 | A1* | 1/2007 | Takahira | H01R 12/88 439/495 |
| 2007/0117451 | A1* | 5/2007 | Yokoyama | H01R 12/88 439/495 |
| 2008/0311778 | A1* | 12/2008 | Aekins | H01R 13/7033 439/344 |
| 2010/0151744 | A1 | 6/2010 | Takahashi et al. | |
| 2011/0212650 | A1* | 9/2011 | Amleshi | H01R 13/514 439/660 |
| 2011/0269344 | A1* | 11/2011 | Lin | H01R 13/2442 439/626 |
| 2012/0164882 | A1 | 6/2012 | Ozeki | |
| 2013/0171884 | A1* | 7/2013 | Ho | H01R 12/724 439/660 |
| 2013/0267110 | A1* | 10/2013 | Kajiura | H01R 12/72 439/329 |

FOREIGN PATENT DOCUMENTS

| | | |
|---|---|---|
| JP | 2004-022539 | 1/2004 |
| JP | 2007-213998 | 8/2007 |
| WO | WO 2013/055578 | 4/2013 |

* cited by examiner

CONNECTOR

FIELD OF THE INVENTION

The present invention relates to a connector for electrically connecting a flexible printed circuit board (hereinafter also referred to as FPC) to another circuit board.

BACKGROUND ART

Conventionally, a connector is known that inserts and fixes the FPC in a housing by attaching an actuator that can rotate in the housing equipped with a terminal to alter a gap of the insertion portion of the FPC in the housing according to the rotation of the actuator (for example, see Patent Document 1). Further, a connector is also known that inserts and fixes the FPC in a housing by inserting a slider with the FPC inserted into an opening provided in the housing (for example, see Patent Document 2).

PRIOR ART DOCUMENTS

Patent Documents

Patent Document 1: Japanese Unexamined Patent Application Publication No. 2006-024373A Patent Document 2: Japanese Unexamined Patent Application Publication No. 2007-213998A

SUMMARY OF THE INVENTION

Problems to be Solved by the Invention

However, with the connector described in the above Patent Document 1, a rotational operation is required for the actuator in order to insert and fix the FPC into the housing, and, with the connector described in the above Patent Document 2, and an insertion operation is required for the slider. Therefore, inserting the FTC into the housing by automatic transport is difficult. Meanwhile, a configuration that does not use an actuator or a slider but that simply inserts the FPC between terminals having a spring structure within the housing requires that the insertion force of the FPC be reduced, making it difficult to obtain stable contact pressure between the FPC and the terminal.

An object of the present invention is to provide a connector that can obtain stable contact pressure between the FPC and the terminal while not requiring a rotational operation by an actuator or an insertion operation by a slider, and the like.

Means for Solving the Problem

An aspect of the present invention is a connector mounted on a circuit board in a mounting direction with a flexible printed circuit board inserted that receives the flexible printed circuit board, including a plurality of first and second terminals arranged in parallel alternately; wherein the plurality of first and second terminals, respectively, comprise a contact portion that electrically contacts a pad portion of the flexible printed circuit board, a mounting portion that electrically contacts a terminal portion of the circuit board, and an intermediate portion that connects the contact portion and the mounting portion; and wherein the contact portions of the plurality of first and second terminals are respectively disposed along a first column and a second column alternately offset in an insertion direction of the flexible printed circuit board, and the intermediate portion of each first terminal has an overlapping region formed along the first column so as to at least partially overlap with an adjacent second terminal.

Further, another aspect of the present invention is a connector that has a plurality of terminals arranged in parallel, wherein a portion of each terminal overlaps a portion of an adjacent terminal in a planar view of the connector.

Additionally, another aspect of the present invention is a connector that receives a flexible printed circuit board, including a plurality of first and second terminals; configured wherein, when the flexible printed circuit board is received into the connector, a first pad portion on a first surface side of the flexible printed circuit board contacts the first terminal, a second pad portion different from the first pad portion on the first surface side of the flexible printed circuit board contacts the second terminal, the first pad portion is interposed between a first portion of the first terminal and a second portion of the first terminal, and the second pad portion is interposed between a first portion of the second terminal and a third portion different from the first portion and the second portion of the first terminal.

Effect of the Invention

According to the present invention, because an overlapping region is provided on an intermediate portion of a first terminal of a connector so as to at least partially overlap with an adjacent second terminal, stable contact pressure between a flexible printed circuit board and a terminal can be obtained.

DETAILED DESCRIPTION

Figure 1A:
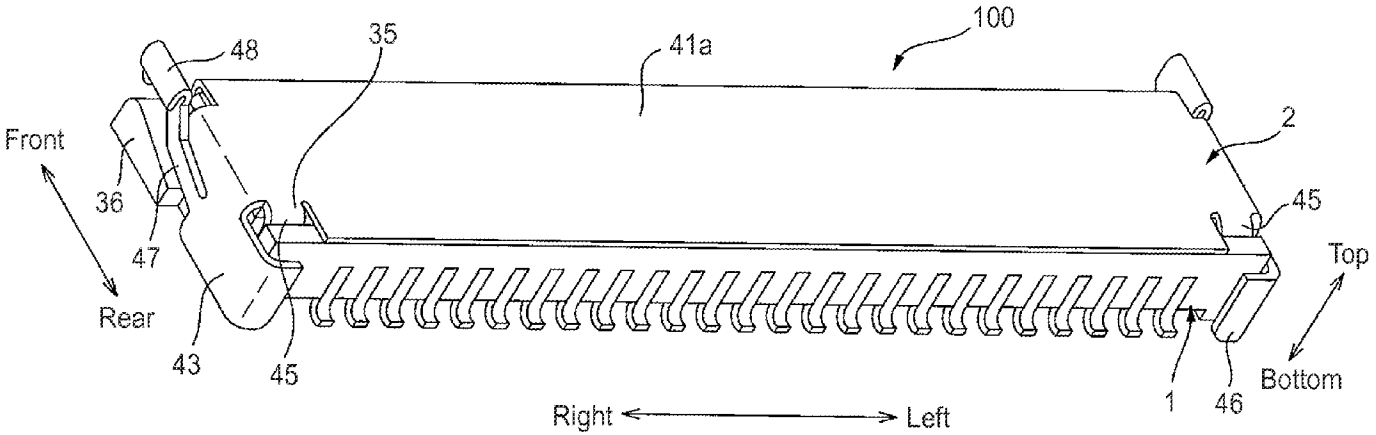
FIGS. 1A and 1B are respective perspective views illustrating an overall configuration of a connector according to an embodiment of the present invention.
Figure 1B:
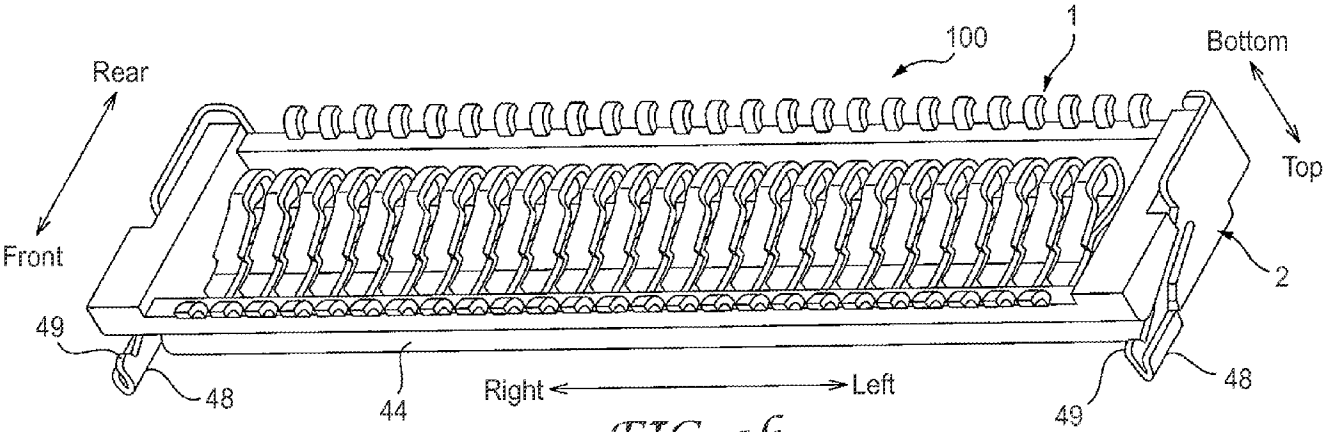
Figure 2:
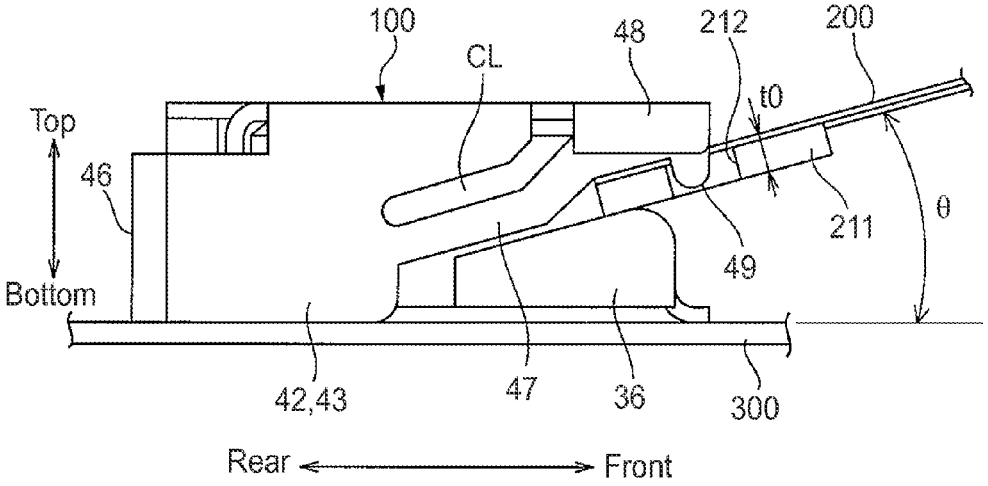
FIG. 2 is a side view illustrating a state of use of the connector of FIG. 1.
Figure 3:
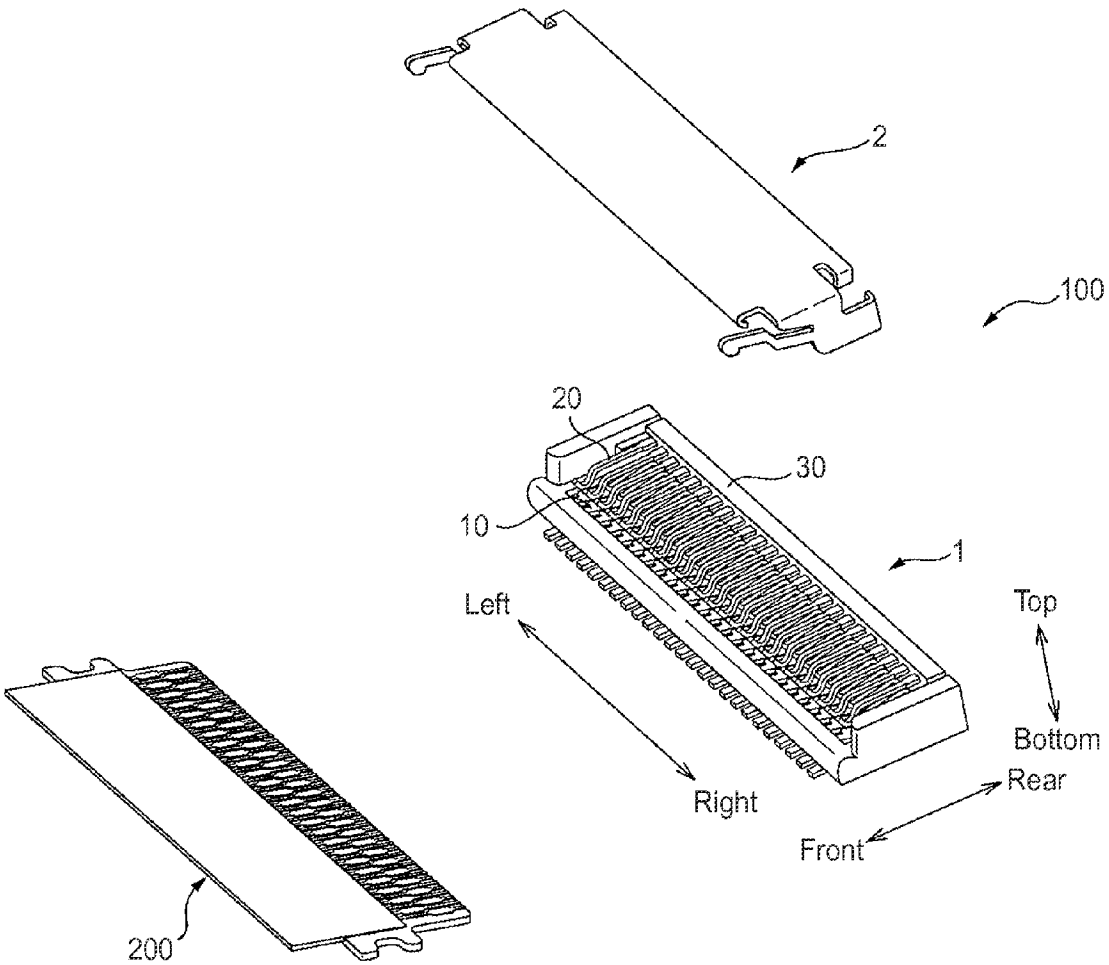
FIG. 3 is an exploded perspective view of the connector of FIG. 1.

Embodiments of the present invention will be explained below with reference to FIGS. 1A to 11. FIGS. 1A and 1B are respective perspective views of the overall configuration of a connector 100 according to an embodiment of the present invention, FIG. 2 is a side view illustrating a state of use of the connector 100, and FIG. 3 is an exploded perspective view of the connector 100. Note that, hereafter, the front and rear direction, left and right direction, and top and bottom direction are defined as illustrated in the drawing for convenience in understanding the description, and configurations of various parts will be described in accordance with these definitions. Note that, FIG. 1A is a drawing of the connector 100 viewed diagonally from above, and FIG. 1B is a drawing viewed diagonally from below.

The connector 100 is used for electrically connecting a flexible printed circuit board 200 (i.e., flexible printed circuits; hereinafter referred to simply as "FPC") and a printed circuit board 300. The FPC 200 is inserted into the connector 100, and, as the connector 100 receives the FPC 200, the connector 100 is mounted on the printed circuit board 300. In other words, the connector 100 is mounted on the printed circuit board 300 from above, and the FPC 200 is inserted, from above, into the connector 100 diagonally from the front. The connector 100 of this embodiment can be used in, for example, a digital camera, mobile phone, and the like, a variety of electronic devices, and particularly, in an electronic device where a small size is required by disposing signal lines in high density.

Figure 4A:
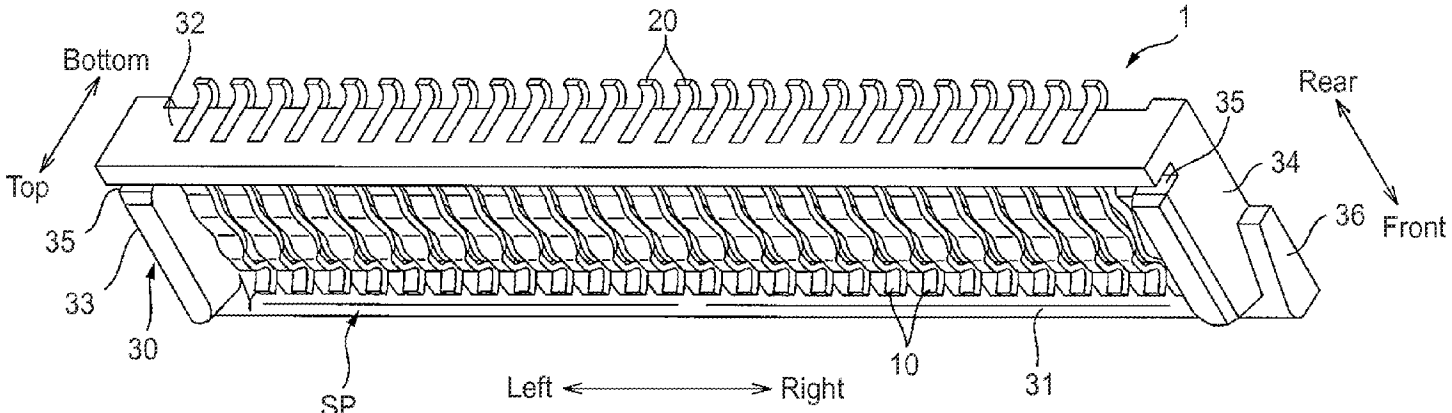
FIGS. 4A and 4B are respective perspective views of a housing assembly illustrated in FIG. 3.
Figure 4B:
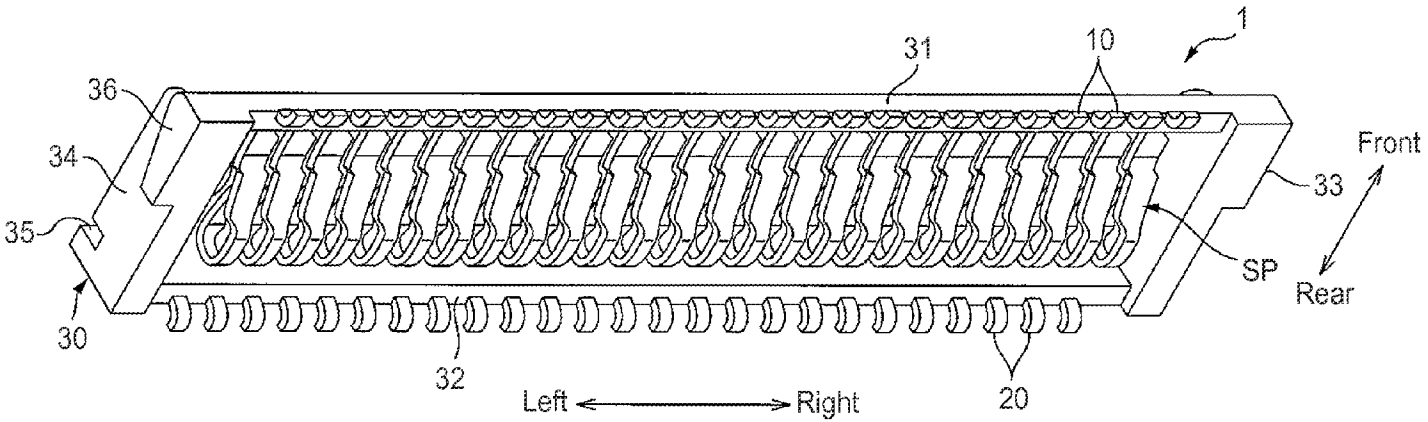
Figure 5:
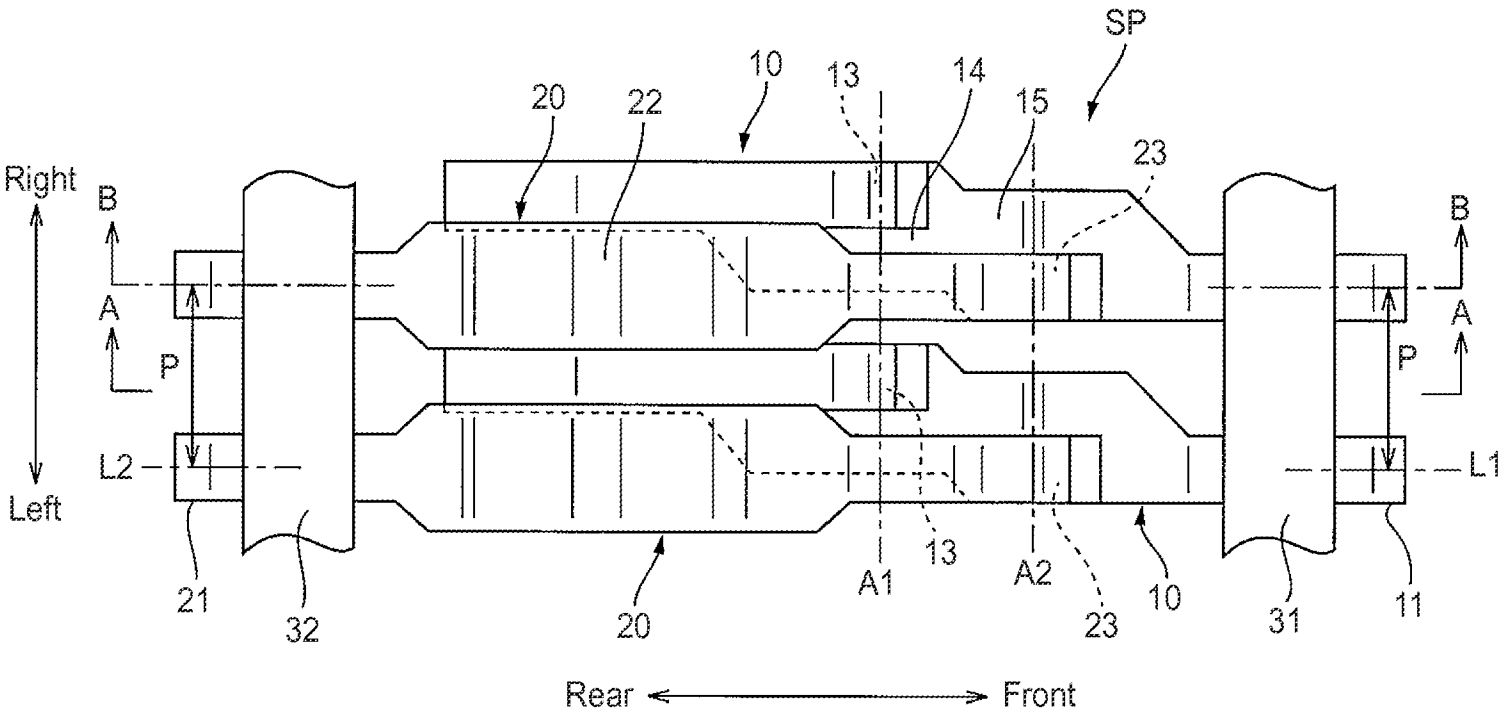
FIG. 5 is a plan view of the housing assembly illustrated in FIG. 3 viewed from above.
Figure 6A:
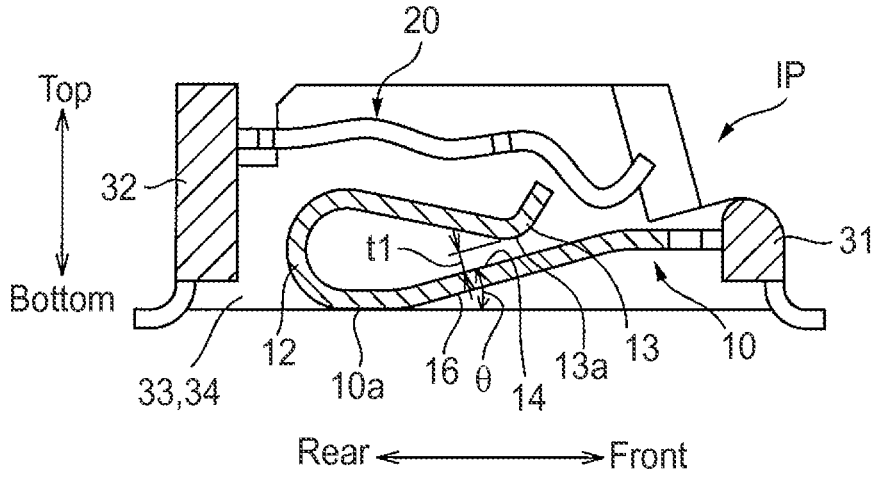
FIGS. 6A and 6B are, respectively, cross-sectional views cut along lines A-A and B-B of FIG. 5.
Figure 6B:
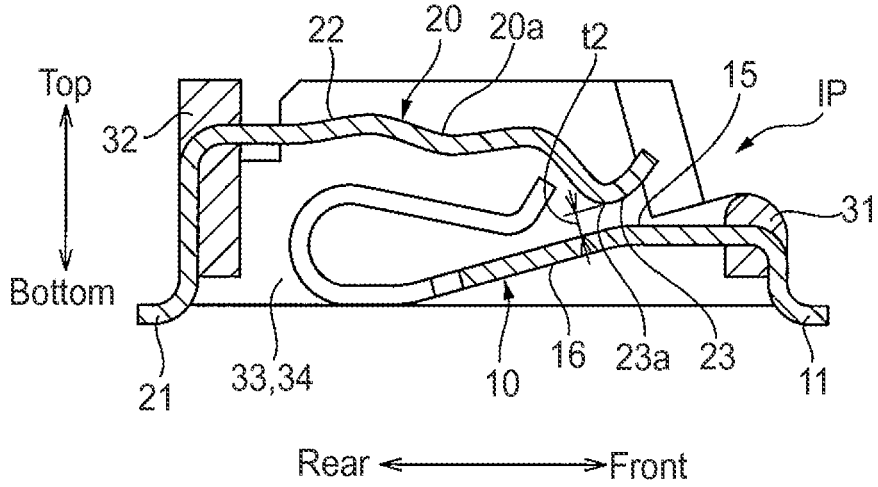

As illustrated in FIGS. 1A and 1B and FIG. 2, the connector 100 has a housing assembly 1 and a cover 2 that is attached to the housing assembly 1. FIGS. 4A and 4B are respective perspective views of the housing assembly 1; FIG. 5 is a plan view of the housing assembly 1 viewed from above; and FIGS. 6A and 6B are cross-sectional views cut along the lines A-A and B-B of FIG. 5, respectively.

As illustrated in FIGS. 4A and 4B and FIG. 5, the housing assembly 1 has a housing 30 in a frame shape that extends in the left and right direction, a plurality of first contact 10, having mutually identical shapes, arranged in plurality in parallel in the left and right direction on the front side of the housing 30, and a plurality of second contacts 20, having mutually identical shapes, arranged in plurality in parallel in the left and right direction on the rear side of the housing 30. The number of first contacts 10 and second contacts 20 is the same number (for example, a total of 25 columns), and the first contacts 10 and the second contacts 20 are arranged alternately in the left and right direction, i.e., staggered, in a space SP in a frame of the housing 30. Disposing the first contacts 10 and the second contacts 20 in a staggered shape allows multiple columns of the contacts 10 and 20 to be efficiently disposed in a narrow pitch in the housing 30. Note that, in FIG. 5, only the front and rear pair of a set of two contacts 10 and 20 is illustrated. The number of first contacts 10 and the second contacts 20 may not be the same number, and the number of first contacts 10 may be more than or fewer than the number of second contacts 20.

The housing 30 is configured of a resin having nonconductive properties such as engineering plastic (for example, liquid crystal polymer) and the like and that has heat resistance according to the use conditions. The contacts 10 and 20 are configured by cutting and bending a thin plate spring alloy (for example, copper alloy) having conductivity and formed by roll forming, into a predetermined shape. The housing 30 and the contacts 10 and 20 are integrated in one piece using insert molding where the contacts 10 and 20 are set in a die while resin is injected. Forming the housing assembly 1 by insert molding allows a multiple number of contacts 10 and 20 to be positioned precisely in the housing 30 compared to press fitting the contacts into the housing after molding.

The housing 30 has a front wall 31 and a rear wall 32 that extend in the left and right direction and left and right side walls 33 and 34 that extend in the front and rear direction, and the contacts 10 and 20 are disposed in the space SP enclosed by the front wall 31, the rear wall 32, and the side walls 33 and 34. As illustrated in FIGS. 6A and 6B, the height of the upper surface of the front wall 31 is lower than the height of the upper surface of the rear wall 32, and an insertion portion IP of the FPC 200 is formed above the front wall 31. The height of the bottom surface of the front wall 31 is equivalent to the height of the bottom surface of the rear wall 32, and the heights of these bottom surfaces are higher than the heights of the side walls 33 and 34. As illustrated in FIGS. 4A and 4B, respective groove portions 35 are provided in the rear end portion upper surfaces of the side walls 33 and 34. A protruding portion 36 that protrudes in the left and right direction contiguous with the front wall 31 is formed on the outer side surface of the side walls 33 and 34. The protruding portion 36 slants downward to the rear corresponding to an arm portion 47 (FIG. 8) of the cover 2 and exhibits a tapered shape in a side view.

As illustrated in FIG. 5 and FIGS. 6A and 6B, the first contact 10 passes through the rear surface and the bottom surface of the front wall 31 and is cantilevered by the front wall 31. The first contact 10 that passes through the bottom surface is bent forward, and a terminal portion 11 is formed on one end portion (front end portion) of the first contact 10 facing forward. Meanwhile, the second contact 20 passes through the front surface and the bottom surface of the rear wall 32 and is cantilevered by the rear wall 32. The second contact 20 that passes through the bottom surface is bent rearward, and a terminal portion 21 is formed on one end portion (rear end portion) of the second contact 20 facing rearward. The bottom surface of the terminal portion 11 and the bottom surface of the terminal portion 21 are soldered to the printed circuit board 300 (FIG. 2).

As illustrated in FIG. 5, L1 is an axis line that extends in the front and rear direction passing through the center of the left and right direction of the terminal portion 11, and L2 is an axis line that extends in the front and rear direction passing through the center of the left and right direction of the terminal portion 21; and the L1 and the L2 are positioned on the same straight line, and the terminal portion 11 and the terminal portion 21 are disposed in identical positions in the left and right direction. The distance between terminal portions 11 and 11, mutually adjacent in the left and right direction, and the distance (pitch P) between the terminal portions 21 and 21 are set respectively to a predetermined value (for example, 0.5 mm).

Figure 7:
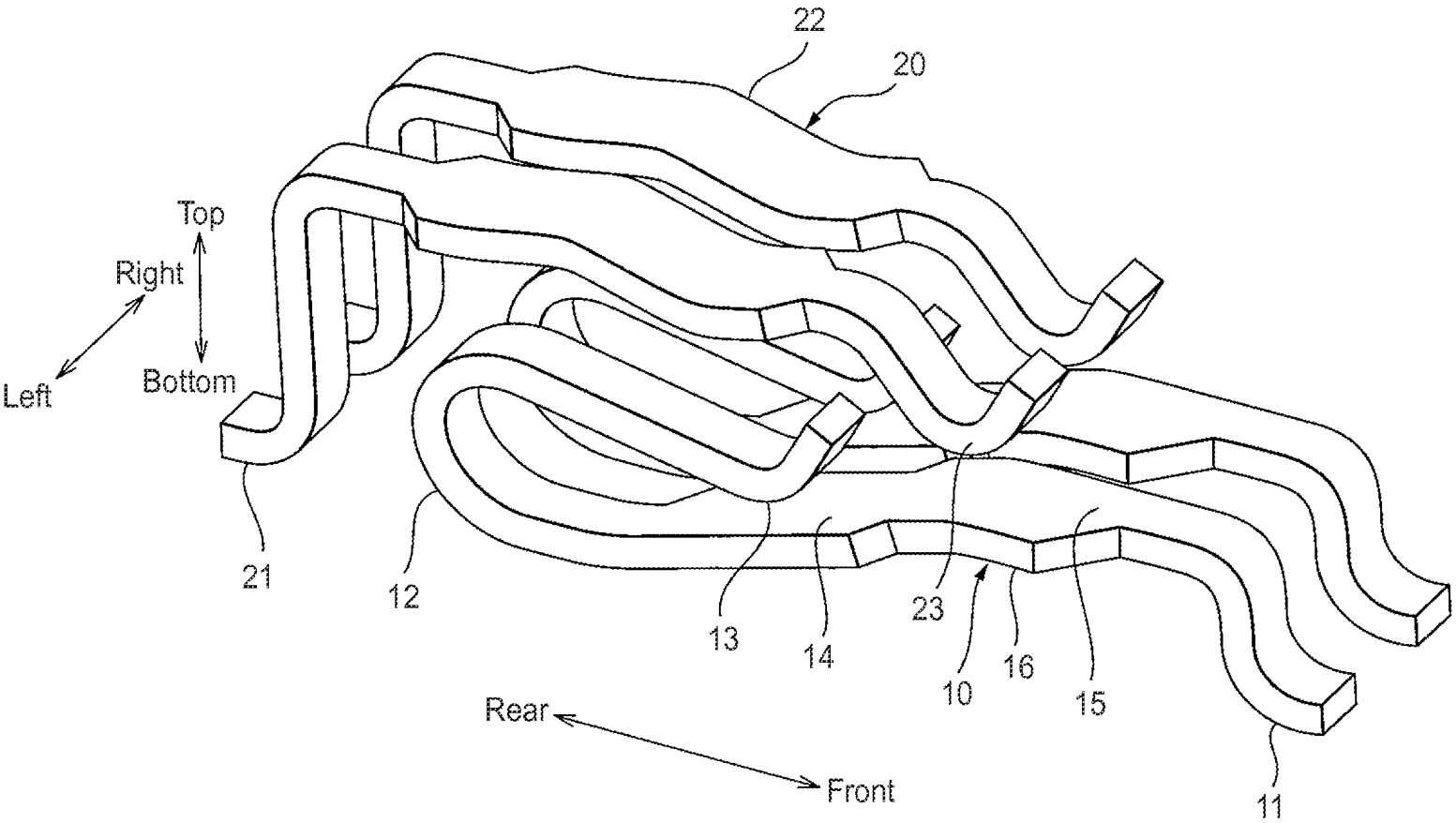
FIG. 7 is a perspective view illustrating a positional relationship of contacts used in the connector according to the embodiment of the present invention.

A shape of the contacts 10 and 20 in the space SP on the inner side of the housing 30 will be described. FIG. 7 is a perspective view illustrating a positional relationship between the contacts 10 and 20. Note that, in FIG. 7, only the front and rear pair of one set of contacts 10 and 20 is illustrated.

As illustrated in FIGS. 5 to 7, the first contact 10 that passes through the rear surface of the front wall 31 slants at a predetermined angle θ (FIG. 6; for example, 15°) relative to a horizontal line and faces rearward and downward, and a sloped part 16 is formed on the first contact 10. The sloped part 16 extends until the bottom surface vicinity of the housing 30. FPC 200 is inserted along the sloped part 16, and the sloped part 16 defines the insertion angle of the FPC 200. The first contact 10 is bent approximately 180° facing forward in a bent portion 12 rearward of the sloped part 16. Additionally, a tip end portion of the first contact 10 is bent diagonally upward, and a contact portion 13 having a convex shape facing downward is formed on a second end portion (opposite side end portion of the terminal portion 11) of the first contact 10. Note that, the portion that connects the contact portion 13 and the terminal portion 11 of the first contact 10 (slope part 16, bent portion 12, and the like) is called an intermediate portion 10*a*.

The first contact 10 is offset to the right rearward of the front wall 31, and the contact portion 13 is provided in a position offset by a half pitch (P/2) to the right from the axis line L1. A first support section 14 that opposes the contact portion 13 is formed below the contact portion 13 of the first contact 10. A second support section 15 is formed on the left diagonal front of the first support section 14. The widths in the left and right direction of the first support section 14 and the second support section 15 are equivalent to each other, and the width in the left and right direction of the end side to the front of the first support section 14 is narrower than the support sections 14 and 15. Accordingly, the first contact 10 has high rigidity at the base end side, the first contact 10 can elastically deform in the top and bottom direction using the bent portion 12 as a fulcrum, and by this, the contact portion 13 can be displaced in the top and bottom direction.

The second contact 20 protrudes from the front surface of the rear wall 32 upward more than the first contact 10. The second contact 20, after extending forward from the front surface of the rear wall 32, bends downward and upward in order, and a contact portion 23 having a convex shape facing downward is formed on a second end portion (opposite side end portion) of the second contact 20. Note that, the portion that connects the contact portion 23 and the terminal portion 21 of the second contact 20 (wide width portion 22 and the like) is called an intermediate portion 20*a*. The contact portion 23 is positioned on the extension of the axis line L2, and the second support section 15 of the first contact 10 is positioned below the contact portion 23. The second contact 20 has the wide width portion 22 rearward of the contact portion 23, and the wide width portion 22 has a higher rigidity than the contact portion 23. Accordingly, the second contact 20 elastically deforms in the top and bottom direction across the entirety, and the front side can especially elastically deform more easily than the wide width portion 22, and by this, the contact portion 23 can be displaced in the top and bottom direction. By making the width of the tip end side of the second contact 20 narrower than the wide width portion 22, contact between the mutually adjacent contact portions 23 in the left and right direction can be prevented.

With the contact portion 13, the distance to the first support section 14 is the shortest at a contact point 13*a*; and with the contact portion 14, the distance to the second support section 15 is the shortest at a contact point 14*a*. A gap t1 between the contact point 13*a* and the first support section 14 and a gap t2 between the contact point 23*a* and the second support section 15 are equivalent to each other and are set to be smaller than the thickness t0 (FIG. 2) of the rear end portion of the FPC 200. At this time, the segment that mutually binds the contact points 13*a* and 23*a* is parallel to the sloped part 16 of the first contact 10, and the FPC 200 is inserted between the sloped part 16 and the contact portions 13 and 23 at the predetermined angle θ relative to a horizontal line (see FIG. 2).

With the housing assembly 1 described above, the contact portion 13 of the first contact 10 and the contact portion 23 of the second contact 20 are alternately disposed each at respective half pitches (P/2) in the left and right direction, and the contact portion 23 is disposed more forward than the contact portion 13. In other words, the contact portion 13 and the contact portion 23 are disposed in mutually different offsetting, i.e., staggered, positions in the front and rear direction and in the left and right direction. Which is to say, as illustrated in FIG. 5, the contact portion 13 is disposed along a first axis line A1 (first column) in the left and right direction 13, and the contact portion 23 is disposed along a second axis line A2 (second column) in the left and right direction forward and diagonally above the first axis line A1, respectively. By this, a multiple number of contact portions 13 and 23 can be disposed in high density in the housing 10.

Furthermore, in this embodiment, the first contact 10 is offset to the right rearward of the front wall 31, and the first support section 14 and the second support section 15 are provided on the first contact 10 below the contact portions 13 and 23 respectively. The gaps t1 and t2 between the contact portions 13, 23 (contact points 13*a*, 23*a*) and the support sections 14, 15 are equivalent to each other and are set to be smaller than the thickness t0 of the tip end portion of the FPC 200. By this, the FPC 200 can be interposed by a predetermined elasticity between a plurality of contact portions 13 and first support sections 14 and between a plurality of contact portions 23 and second support sections 15, and stable contact pressure between the contact portions 13, 23 and the FPC 200 can be obtained. Note that, the contact pressure in the contact portions 13, 23 is determined by the rigidity of the contacts 10 and 20, and as long as the contact pressure is equivalent to each other, the gaps t1 and t2 may not be equivalent to each other. However, if the gaps t1 and t2 are equivalent, management of the gaps t1 and t2 is easier.

In this case, reducing the size of the gaps t1 and t2 increases the insertion force of the FPC 200. Particularly, when the connector 100 has a multiple number of contacts 10 and 20, the insertion force increases in proportion to the number of contacts 10 and 20. In this embodiment, in order to suppress the insertion force of the FPC 200 to a predetermined value (for example, around 0.5 N), the gaps t1 and t2 are set to be a predetermined value larger than the thickness t0 of the FPC 200. By this, the FPC 200 can be easily inserted without the insertion force becoming too great.

Figure 8:
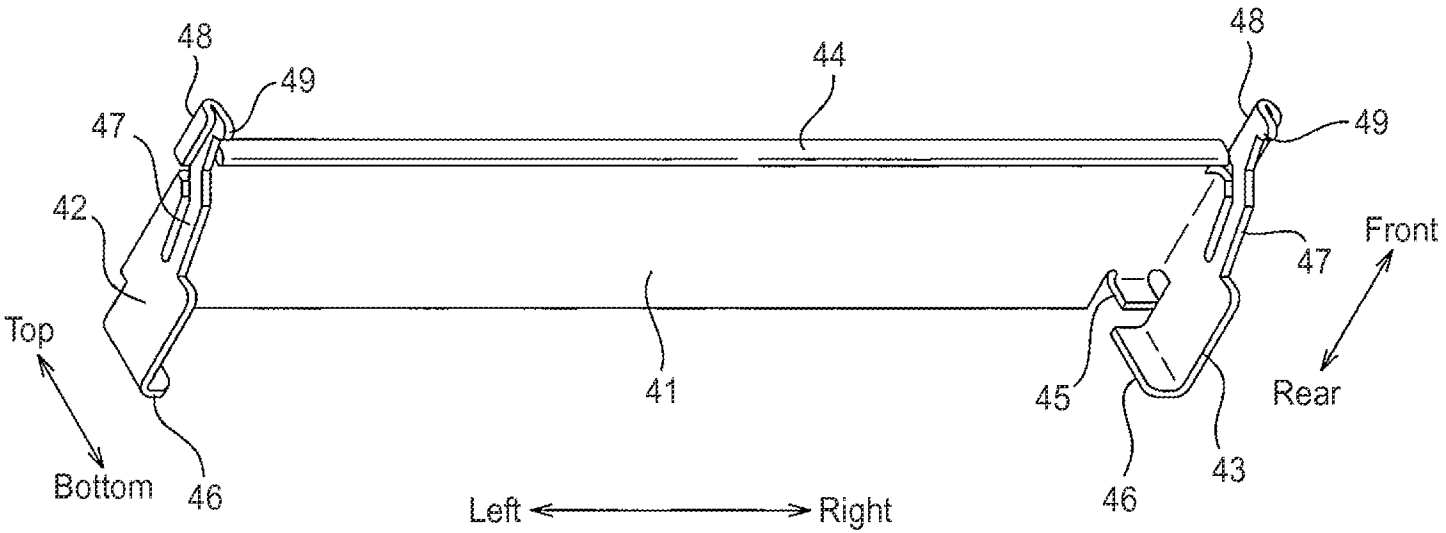
FIG. 8 is a perspective view of a cover illustrated in FIG. 3.

FIG. 8 is a perspective view (drawing viewed diagonally from below) of the cover 2.

As one example, the cover 2 is configured by cutting metal from a thin plate, such as stainless steel, in a predetermined shape and bending into a predetermined shape to exhibit overall left-right symmetry. As illustrated in FIG. 8, the cover 2 has a flat portion 41 extending in the left and right direction and a left and right pair of side plate portions 42 and 43 bent downward from both the left and right end surfaces of the flat portion 41. The front end portion of the flat portion 41 is bent downward to form a front plate portion 44. As illustrated in FIG. 1, an upper surface 41*a* of the flat portion 41 is formed flat to be suctionable by the automatic transport device not illustrated.

The rear end of the flat portion 41 and both left and right rear end portions are bent downward to form an engaging pawl 45. The rear end portions of the side plate portions 42 and 43 are bent toward the inner side in the left and right directions to form a rear plate portion 46. As illustrated in FIG. 2, the side plate portions 42 and 43, and the bottom surface of the rear plate portion 46 are soldered to the printed circuit board 300 when the connector 100 is mounted on the printed circuit board 300.

As illustrated in FIGS. 1A and 1B, FIG. 2, and FIG. 8, an arm 47 facing forward and diagonally upward is extended to the side plate portions 42 and 43 to correspond to the protruding portion 36 of the housing assembly 1 (housing 30). The tip end portion of the arm 47 has a U portion 48 formed thereon that is bent in a U shape to the outer side in the left and right direction. The U portion 48 extends forward maintaining the same height as the upper surface 41*a* of the flat portion 41 and protrudes forward more than the front plate portion 44. Forming the arm tip end portion into a U shape increases the rigidity of the arm tip end portion. As illustrated in FIGS. 1A and 1B and FIG. 8, a hook 49 that protrudes downward is formed on the inner side front end portion in the left and right direction of the U portion 48.

As illustrated in FIGS. 1A and 1B, the engaging pawl 45 of the cover 2 is pressed to engage in a groove portion 35 of the upper surface of the housing assembly 1. In this manner, the cover 2 and the housing assembly 1 are integrated thereby assembling the connector 100. At this time, the front plate portion 44 and the rear plate portion 46 of the cover 2, and the left and right side plate portions 42 and 43 hold the front surface, the rear surface, and the left and right side surfaces, respectively, of the housing assembly 1. Furthermore, the arm 47 of the cover 2 extends forward along the protruding portion 36 of the housing assembly 1, and the hook 49 protrudes facing downward on the front of the front wall 31 of the housing assembly 1. As illustrated in FIG. 2, because a gap CL is above the arm 47, the arm 47 can elastically deform upward using the base end (rear end) as a fulcrum, and by this, the hook 49 can be displaced upward.

It is preferred that the cover 2 is manufactured so that at least the top surface of the side facing the terminal is made of an electrical insulation. When doing so, the cover 2 may be produced such that (1) the cover itself is produced from a resin material having electrical insulating properties, or (2) a resin material layer is provided on the top surface of the cover made of a metal material. An example of a mounting aspect for when this type of cover is used includes producing a cover using reflow heat resistant insulating film and providing a through hole in a location corresponding to a housing outer peripheral portion of the cover and providing a raised portion in a location corresponding to the through hole of the housing outer peripheral portion, and attaching and fixing the cover to the housing by joining the through hole and the raised portion using an ultrasonic welding method or the like.

Figure 9A:
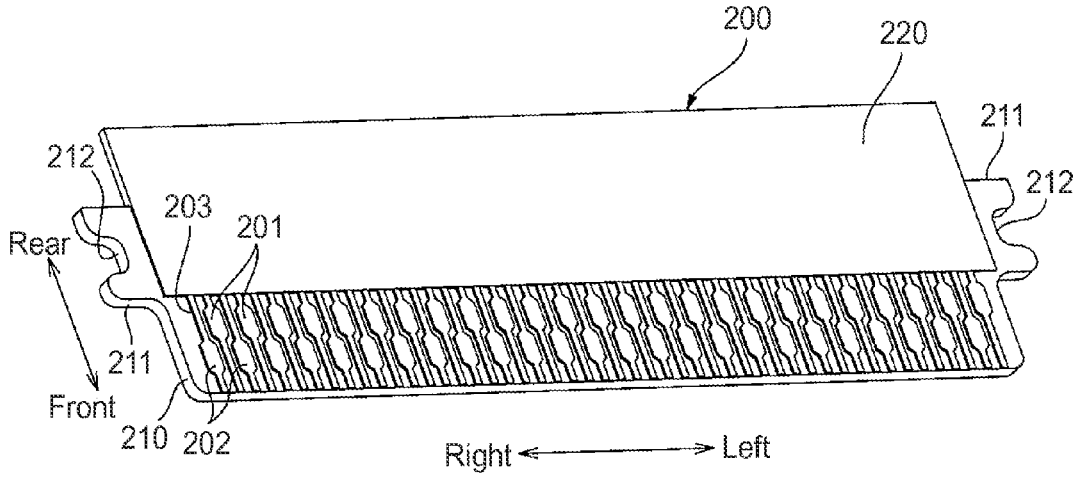
FIGS. 9A and 9B are respective perspective views of a flexible printed circuit board to which the connector according to the embodiment of the present invention is applied.
Figure 9B:
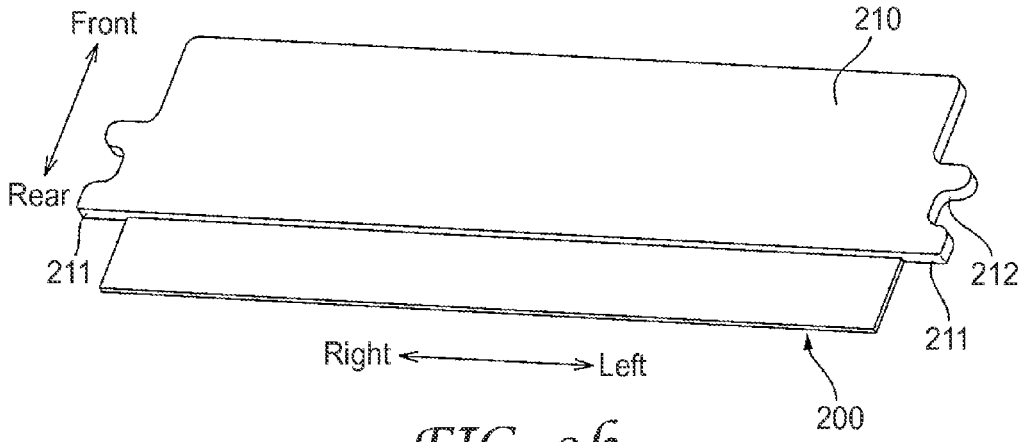

FIGS. 9A and 9B are respective perspective views of the FPC 200 applied to the connector 100 of the embodiment. Note that, in FIG. 9, the front and rear direction and the left and right direction are defined according to FIG. 3. The FPC 200 has an adhesive layer formed on a film-like insulator (base film) having a predetermined thickness (for example, approximately 10 to 50 μm), and furthermore, a conductive foil having a predetermined thickness (for example, approximately 10 to 50 μm) is layered thereon, and wiring has a predetermined pattern.

Staggered pad portions 201 and 202 are formed on the front end portion of the FPC 200 to correspond to the positions of the contact portions 13 and 23. In other words, The pad portion 201 and the pad portion 202 are formed at a predetermined pitch P in the left and right direction, respectively, and the pad portion 201 and the pad portion 202 are formed in a position offset in the front and rear direction and offset in the left and right direction by only a half pitch P/2. The pad portions 201 and 202 are wider than a wearing portion 203 that extends in the front and rear direction contiguous with the pad portions 201 and 202, and disposing the pad portions 201 and 202 in a staggered shape allows a multiple number of pad portions 201 and 202 to be efficiently disposed.

On the back surface of the pad portions 201 and 202, a base material 210 having a predetermined thickness (for example, 0.2 mm) is bonded so that the insertion of the FPC 200 into the connector 100 is easy. An ear portion 211 protrudes on both left and right end portions of the base material 210, and a notch 212 is provided on the end surface of the left and right outer side of the ear portion 211 for engaging with the hook 49 (FIG. 8) of the cover 2. Insulating tape 220 is affixed to the rear part of the pad portions 201 and 202. The insulating tape 220 forms an adsorption surface that is adsorbed by the automatic transport device.

A use example of the connector 100 according to this embodiment will be described. First, the cover 2 is pressed into the housing assembly 1 to assemble the connector 100 as illustrated in FIG. 1. Next, the upper surface 41*a* of the cover 2 is adsorbed by the automatic transport device, and the connector 100 is placed from above in a predetermined position on the printed circuit board 300. In this state, the terminal portions 11 and 21 of the connector 100 are soldered to terminal portions 301 (FIGS. 10A and 10B) of the printed circuit board 300 to form an electrical connection between the terminal portions 11, 21 and the printed circuit board 300, and then, the bottom surface of the side plate portions 42, 43 of the cover 2 and the bottom surface of the rear plate portion 46 are soldered to the printed circuit board 300 such that the connector 100 is stably fixed onto the printed circuit board 300.

Next, the upper surface (insulating tape 220) of the FPC 200 is adsorbed by the automatic transport device, and the FPC 200 is inserted from the front into the insertion portion IP (FIG. 6) of the front side of the connector 100 at a predetermined insertion angle θ relative to a horizontal line. At this time, the first contact 10 and the second contact 20 elastically deform by the insertion force of the FPC 200, and the FPC 200 is interposed between the contact portion 13 and the first support section 14, and the contact portion 23 and the second support section 15.

Figure 10A:
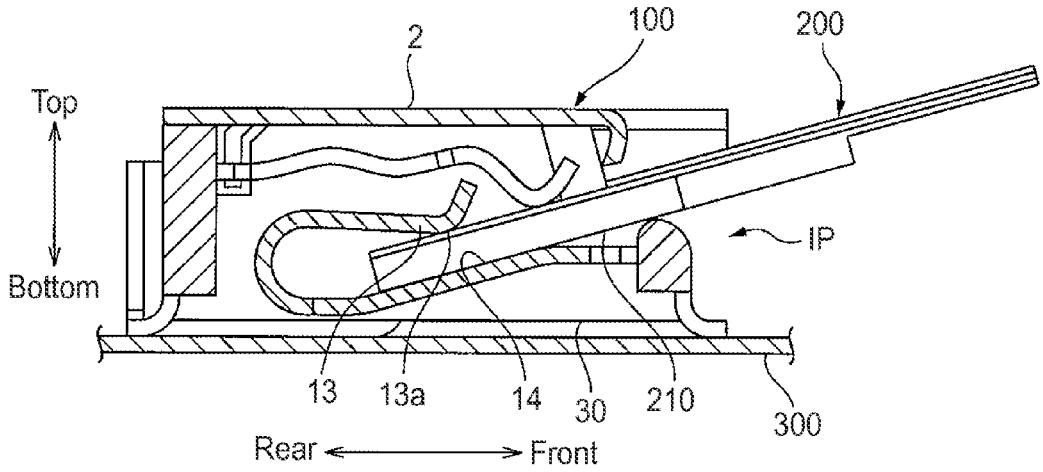
FIGS. 10A and 10B are respective perspective views illustrating the flexible printed circuit board inserted in an insertion portion of the connector according to the embodiment of the present invention.
Figure 10B:
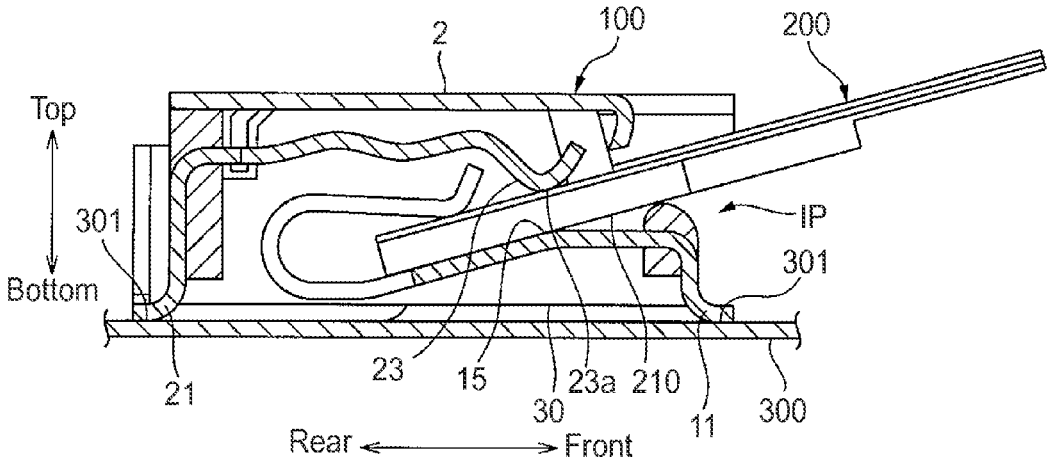

FIGS. 10A and 10B are cross-sectional views of the contact portion 13 and the contact portion 23 illustrating when the FPC 200 is inserted into the insertion portion IP of the connector 100, respectively. When inserting the FPC 200, the contact portions 13 and 23 displace upward from the state illustrated in FIG. 6A and FIG. 6B, and the pad portions 201 and 202 of the FPC 200 contact the contact points 13*a* and 23*a*, respectively, of the contact portions 13 and 23 as illustrated in FIGS. 10A and 10B. By this, the FPC 200 can be electrically connected to the printed circuit board 300 via the connector 100.

Because the FPC 200 is inserted diagonally, the gap between the FPC 200 and the printed circuit board 300, when the FPC 200 is received by the connector 100, is larger than when the FPC 200 is inserted horizontally. Therefore, interference with the FPC 200 can be significantly reduced and a variety of components can be easily mounted to the printed circuit board 300.

When inserting the FPC 200 into the connector 100, after the arm 47 of the cover 2 deforms upward and the hook 49 rides on the upper surface of the ear portion 211 of the FPC 200, the hook 49 invaginates into the notch 212 of the ear portion 211 as illustrated in FIG. 2. By this, the hook 49 locks into the notch 212, and the FPC 200 can be prevented from separating from the connector 100.

According to this embodiment, the following effects can be achieved.

(1) The connector 100 of this embodiment is provided with a plurality of first contacts 10 and second contacts 20 arranged in parallel alternately in the left and right direction, and each contact 10 and 20 has contact portions 13 and 23 that electrically contact to the pad portions 201 and 202 of the FPC 200, terminal portions 11 and 21 that electrically contact the terminal portion 301 of the printed circuit board 300, and intermediate portions 10*a* and 20*a* that connect the contact portions 13, 23 and the terminal portions 11, 21. The contact portions 13 and 23 of each contact 10 and 20 are respectively disposed along the first axis line A1 (first column) and the second axis line A2 (second column) mutually offset in the insertion direction of the FPC 200, and the first support section 14, having a wide width in the left and right direction so as to overlap with the contact portion 13, is formed together with the second support section 15, having a wide width in the left and right direction so as to overlap with the contact portion 23 of the adjacent second contact 20, on the intermediate portion 10*a* of the first contact 10.

By this, the connector 100 can dispose a multiple number of contact portions 13 and 23 in a staggered shape while interposing the FPC 200 between the contact portion 13 of the first contact 10 and the first support section 14, and the contact portion 23 of the first contact 20 and the second support section 15, respectively. Providing the support sections 14 and 15 respectively below the contact portions 13 and 23 in this manner allows the insertion force into the connector 100 by the FPC 200 to be suppressed while also generating a predetermined contact pressure between the contact portions 13, 23 and the FPC 200. Further, because the FPC 200 is inserted diagonally from above the connector 100, the FPC 200 can be inserted using an automatic transport thereby enabling attachment of the FPC 200 into the connector 100 to be automated.

(2) Because the second support section 15 is provided on the first contact 10 so as to overlap with the contact portion 23 of the second contact 20, stable contact pressure can be obtained in the contact portion 23.

(3) Because the gap t1 between the contact point 13*a* of the contact portion 13 and the first support section 14, and the gap t2 between the contact point 23*a* of the contact portion 23 and the second support section 15 are set to be equivalent to each other, predetermined contact pressures can be generated, respectively, between the FPC 200 and the contact portions 13, 23.

(4) Because the pad portion 202 is provided on the FPC 200 corresponding to the contact portion 23 of the second contact 20, and the pad portion 202 is interposed between the contact portion 23 and the second support section 15 when the FPC 200 is received into the connector 100, stable contact pressure can be secured in the pad portion 202.

(5) Because the pad portion 201 is provided on the FPC 200 corresponding to the contact portion 13 of the first contact 10, and the pad portion 201 is interposed between the contact portion 13 and the first support section 14 when the FPC 200 is received into the connector 100, stable contact pressure can be secured in the pad portion 201.

(6) Because the contact portion 13 of the first contact 10 and the contact portion 23 of the second contact 20 are provided respectively above the FPC 200, the pad portions 201 and 202 may be formed on only one side of the FPC 200 thereby providing a simple configuration for the FPC 200.

(7) The FPC 200 may be inserted into the connector 100 at a predetermined angle θ relative to a horizontal line. In other words, the insertion direction of the FPC 200 into the connector 100 is slanted relative to the mounting direction (top and bottom direction) of the connector 100. By this, the maximum height of the connector 100 can be suppressed, the entrance of the insertion portion IP of the connector 100 can be set high, and interference between the FPC 200 and various components mounted to the printed circuit board 300 can be easily prevented.

Figure 11:
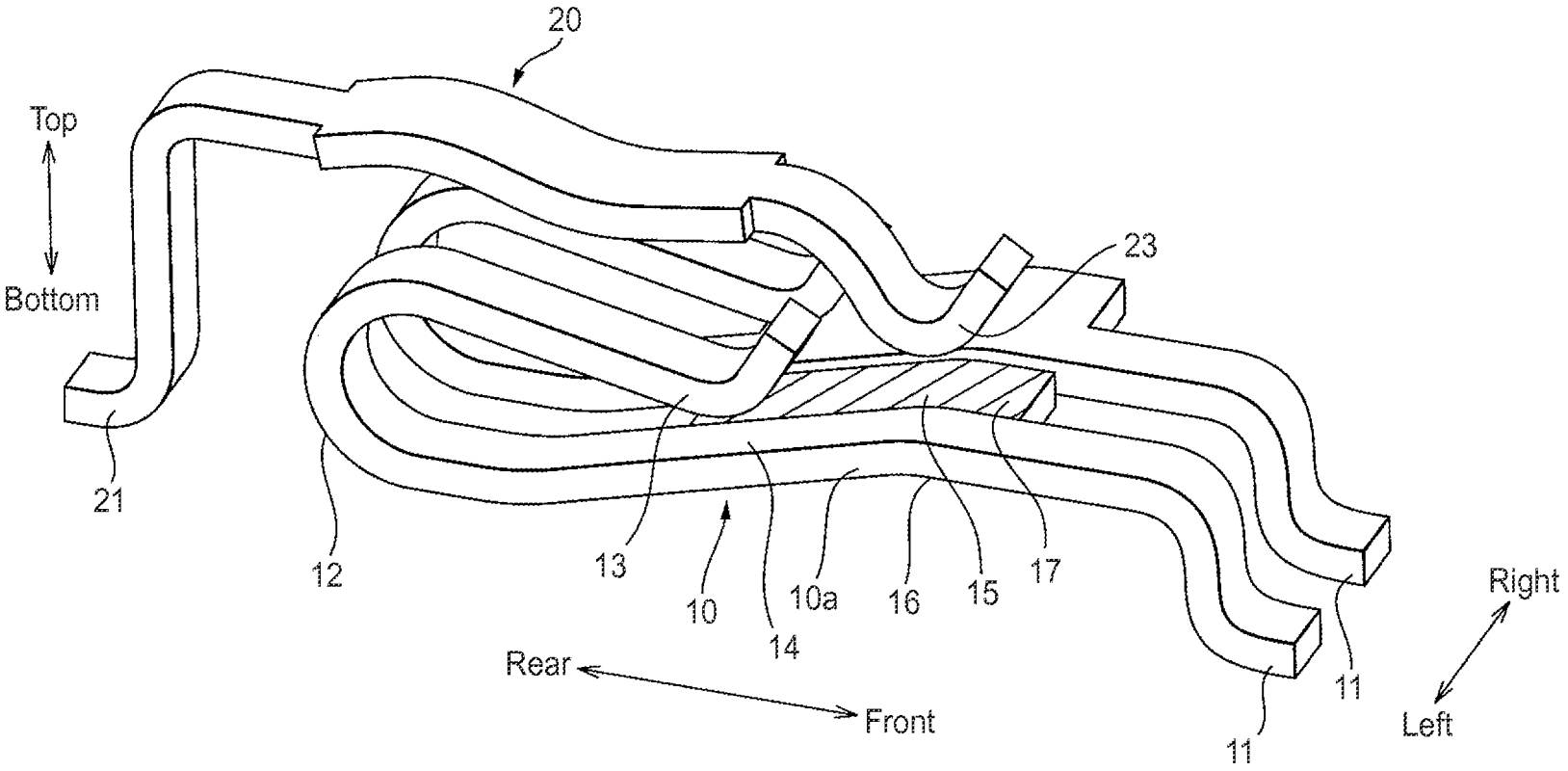
FIG. 11 is a drawing illustrating a modified example of FIG. 7.

Note that, in the above embodiment, the intermediate portion 10*a* of the first contact 10 is offset in the left and right direction to form the first support section 14 on the intermediate portion 10*a*, but the intermediate portion 10*a* may be offset in the left and right direction to form the second support section 15, and the configuration of the first contact 10 is not limited to that described above. FIG. 11 is a drawing illustrating a modified example of FIG. 7. Note that, in FIG. 11, only one second contact 20 is illustrated with two first contacts 10. The configuration of the second contact 20 is identical to that illustrated in FIG. 7, and the configuration of the first contact 10 is different from that illustrated in FIG. 7.

(8) Because the cover is provided in a vicinity above the first and second terminals, the introduction of foreign matter into the connector can be prevented.

(8) Because a cover, formed having at least the top surface of the side facing the first and second terminals formed from an electrically insulating material, is provided in a vicinity above the first and second terminals, introduction of foreign material into the connector can be prevented while also preventing electrically shorting the terminal with the cover.

In the example illustrated in FIG. 11, the positions in the left and right direction of the terminal portion 11 and the terminal portion 21 are mutually offset by a half pitch P/2. The intermediate portion 10*a* of the first contact 10 is formed in the same position in the left and right direction as the sloped part 16, the bent portion 12, and the contact portion 13, respectively, without being offset in the left and right direction, and the first support section 14 is formed below the contact portion 13. The sloped part 16 has a protruding portion 17 (shaded area) to the right. The protruding portion 17 is positioned below the contact portion 23 of the second contact 20, and the protruding portion 17 configures the second support section 15. Note that, in FIGS. 7 and 11, the contact portion 23 is disposed in front of the contact portion 13, but the contact portion 13 may be disposed in front of the contact portion 23.

In other words, as long as the intermediate portion 10*a* of the first contact 10 (first terminal) forms an overlapping region corresponding to the contact portion 23 along a first column A1 of the intermediate portion 10*a* so that there is at least a partial overlap with the adjacent second contact 20 (second terminal), any configuration of the first contact 10 may be used. For example, the entirety or only a portion of the contact portion 23 may be made so as to overlap with the first contact 10. Here, overlap means that a mutually overlapping region is generated when the first contact 10 and the second contact 20 are projected on the same plane. The second support section 15, as the overlapping region, may be provided in a position offset in the front and rear direction or in the left and right direction from the contact portion 23 without being directly below the contact portion 23, and something other than the contact portion 23 of the second contact 20 may be made to overlap with the intermediate portion 10*a* of the first contact 10. Any configuration of the terminal portions 11 and 21 may be used as the mounting portion to electrically contact with the terminal portion 301 of the printed circuit board 300 (substrate).

The connector 100 of this embodiment may exhibit any of the following.

Namely, the connector 100 that receives the FPC 200 is provided with a plurality of first contacts 10 and second contacts 20, and is configured such that, when the FPC 200 is received into the connector 100, the pad portion 201 (first pad portion) on the first surface (upper surface) side of the FPC 200 contacts the first contact 10, the pad portion 202 (second pad portion) that is different from the pad portion 201 on the first surface side of the FPC 200 contacts the second contact 20, the pad portion 201 is interposed between the contact portion 13 (first portion) of the first contact 10 and the first support section 14 (second portion) of the first contact 10, and the pad portion 202 is interposed between the contact portion 23 (first portion) of the second contact 20, the contact portion 13 of the first contact 10, and the second support section 15 (third portion) that is different from the first support section 14.

The connector 100 of this embodiment has a plurality of terminals (first contact 10 and a second contact 20) arranged in parallel, wherein its principal feature is in that, in a planar view (FIG. 5) of the connector 100, a portion of each of the terminals 10 and 20 overlap with a portion of the adjacent terminals 10 and 20, as long as this feature is present, any modification to the configuration of the connector 100 without limitation to the embodiments described above is possible.

The description given above is and will always be only one example, and the present invention is not limited by the embodiments and modified examples described above so long as the characteristics of the present invention are not violated. The constituent elements of the embodiments and modified example encompass all potentially or obviously replaceable variations that maintain the identity of the invention. In other words, other forms conceivable within the scope of the technical concept of the present invention are encompassed within the scope of the present invention. In addition, any combination of one or more of the embodiments and modified examples described above are possible.

REFERENCE NUMERALS

2 cover
10 first contact
20 second contact
30 housing
10*a*, 20*a* intermediate portion
11, 21 terminal portion
13, 23 contact portion
14 first support section
15 second support section
100 connector
200 flexible printed circuit board (FPC)
201, 202 pad portion
300 printed circuit board
301 terminal portion
A1 first axis line
A2 second axis line

What is claimed is:

1. A connector comprising:

a plurality of first terminals arranged along a first row and a plurality of second terminals arranged along a second row, each of the first and second terminals comprising, a contact portion for electrically contacting a pad portion of a flexible printed circuit board inserted into the connector, a mounting portion for electrically contacting a terminal portion of a circuit board on which the connector is mounted, and an intermediate portion that connects the contact portion and the mounting portion, wherein the intermediate portion of each first terminal comprises:

a first support section aligned with and facing the contact portion of the first terminal, and a second support section aligned with and facing the contact portion of a second terminal.

2. The connector according to claim 1, wherein when a flexible printed circuit board is inserted into the connector and the contact portion of a second terminal makes contact with a pad portion of the flexible printed circuit board, the second support section of a first terminal that is aligned with and faces the contact portion of the second terminal, generates a predetermined contact pressure between the contact portion of the second terminal and the pad portion of the flexible printed circuit board.

* * * * *